United States Patent [19]

Perreault et al.

[11] Patent Number: 4,950,195

[45] Date of Patent: Aug. 21, 1990

[54] CARTRIDGE FUSE TERMINAL ADAPTER

[75] Inventors: Richard J. Perreault, Amesbury; David E. Suuronen, Newburyport, both of Mass.

[73] Assignee: Gould, Inc., Rolling Meadows, Ill.

[21] Appl. No.: 194,360

[22] Filed: May 16, 1988

[51] Int. Cl.[5] ..... H01R 11/22

[52] U.S. Cl. ..... 439/830; 439/628

[58] Field of Search ..... 439/628, 830–833

[56] References Cited

U.S. PATENT DOCUMENTS

| | | | |
|---|---|---|---|
| 2,889,533 | 6/1959 | Nielsen | 339/256 |
| 3,118,035 | 1/1964 | Lebens | 200/119 |
| 3,246,106 | 4/1966 | Sommers | 200/133 |
| 4,023,884 | 5/1977 | Morlan | 439/830 |
| 4,128,291 | 12/1978 | Peterson | 339/154 A |
| 4,613,195 | 9/1986 | Suher et al. | 339/31 R |

*Primary Examiner*—Joseph H. McGlynn

*Attorney, Agent, or Firm*—Fish & Richardson

[57] ABSTRACT

An adapter for cartridge fuses having ferrule type terminals which allows installing the fuses in larger size fuse holders. The adapter includes a solid body having a fuse clip engaging portion at one end and a fuse engaging portion at the other end. The fuse engaging portion is made up of two arcuate contact sections. One contact section is fixed with respect to the fuse clip engaging portion. The other contact section is allowed to circumferentially flex with respect to both the fuse clip engaging portion and the other contact section.

6 Claims, 4 Drawing Sheets

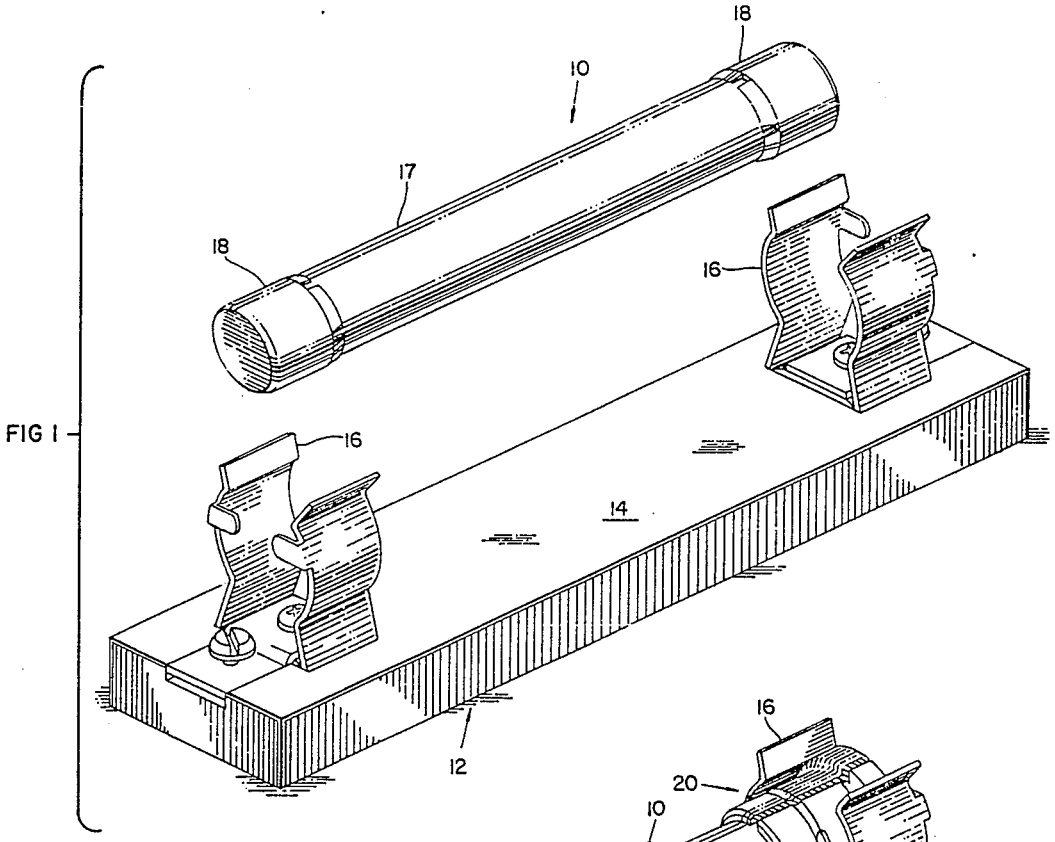
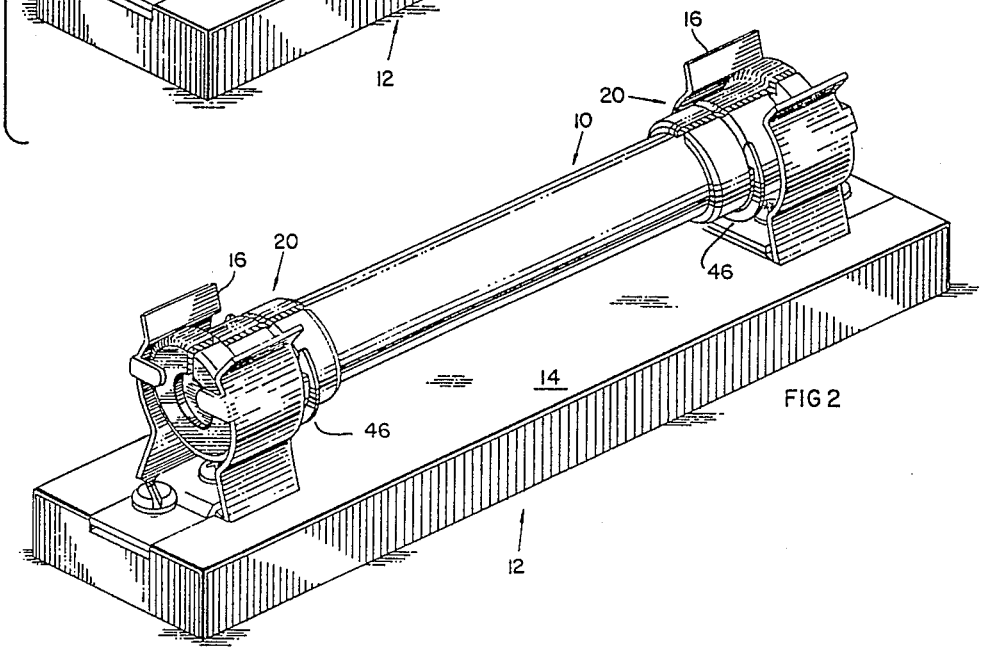
FIG 2

CARTRIDGE FUSE TERMINAL ADAPTER

BACKGROUND OF THE INVENTION

1. Field of the Invention

This invention relates to cartridge fuses and in particular to a terminal adapter configuration which makes it possible to install an electric fuse in a fuse holder which is normally adapted to receive a larger size fuse.

2. Description of the Prior Art

It is frequently desirable to replace the electric fuses in a fuse box or on a panel board with electric fuses having a smaller rating. In most instances the fuses having the smaller rating have physical dimensions that are smaller than the physical dimensions of the fuses they replace. Where this is the case, the fuses having the smaller rating usually will not properly fit the fuse clips in the fuse box or on the panel board. To enable the fuses, which have the smaller physical dimensions to be installed in intimate electrical connection with the fuse clips, it is customary to provide adapters which are attached to the end terminals of the fuses having the smaller physical dimensions. The adapters, in turn, will snugly engage the fuse clips designed for the higher rating fuses and thereby intimately electrically connect those fuses with those fuse clips. The present invention provides such an adapter for electric fuses which is simple, inexpensive, strong and extremely effective.

The fuse terminal adapters shown in U.S. Pat. Nos. 2,889,533, 3,118,035, 3,246,106, 4,128,291 and 4,613,195 are fairly typical of the adapters heretofore in use. For example, U.S. Pat. No. 2,889,533 shows a clip-type fuse holder incorporating an adapter which accommodates the installation of a fuse having either ferrule or knife-blade type terminals. U.S. Pat. No. 4,128,291 shows a clip-type fuse holder incorporating an adapter accommodating the installation of a fuse having either ferrule or knife-blade type terminals. U.S. Pat. No. 3,118,035 shows an adapter for fuses having knife-blade type terminals. U.S. Pat. No. 4,613,195 shows fuse terminal adapters for adapting both ferrule and knife-blade fuses of the rejection type.

U.S. Pat. No. 3,246,106 relates to a fuse adapter which engages one ferrule of a "J" type fuse thereby allowing installation of such fuse in an "H" type fuse holder. The fuse adapter of the '106 patent includes a ferrule receiving bore defined by a plurality of axially extending radially displaceable arcuate conducting fingers. A "circlet" encircles the ferrule gripping fingers. The fingers of this adapter flex outwardly in a manner such that the fuse ferrule contacting surface will have a varying diameter from a maximum at the outward ends of the fingers to a minimum where the fingers merge into the body of the adapter. Such an arrangement may result in poor contact with the ferrule. It is not clear how the fingers of this adapter may expand to accommodate the ferrule with the solid circlet surrounding the fingers.

The present invention is directed towards an adapter for one of the ferrule type terminals of a ferrule type cartridge fuse which makes it possible to couple the one terminal of the fuse to a fuse clip which is adapted to operably engage a terminal of a larger size. The adaptor has a ferrule receiving bore which is defined by a pair of arcuate sections. One of the arcute sections is configured to uniformly circumferentially expand to accomodate the fuse ferrule in a manner whereby both arcuate contact surface are in good electrical surface contact with the fuse ferrule.

SUMMARY OF THE INVENTION

The present invention relates to adapters for the ferrule type terminals of a ferrule type cartridge fuse which makes it possible to couple the ferrule type terminals of the fuse to a fuse clip which is adapted to operably engage terminals of a larger size or of the knife-blade type. The adapter includes a body portion having a fuse clip engaging portion forming one end of the body. The other end of the body comprises a fuse engaging portion. The fuse engaging portion includes a bore provided therein for receiving a ferrule-type terminal of the cartridge fuse. The bore has a diameter which is slightly less than the outside diameter of the ferrule-type terminal to be received therein. The fuse receiving bore is defined by a first circumferentially extending arcuate contact section. The first contact section is integrally formed with and substantially fixed with respect to the fuse clip engaging portion of the body. The fuse receiving bore further comprises a second circumferentially extending arcuate contact section. The second contact section is integrally formed with the first arcuate section at a first longitudinally extending position on the circumference of the fuse receiving portion. The first arcuate section and the second arcuate section are separated from one another at a second longitudinally extending position which is angularly displaced from the first longitudinally extending position on the circumference of the fuse receiving portion. The second arcuate section is also completely separated from the fuse clip engaging portion in the arcuate region extending between the first and second longitudinally extending portions. The second circumferentially extending arcuate section has a material thickness which allows it to circumferentially flex with respect to the first contact section and the fuse clip engaging portion. As a result, upon insertion of a ferrule type terminal into the bore of the adapter the second arcuate section will uniformly circumferentially expand to adapt to the outside diameter of the ferrule type terminal urging the ferrule type terminal into contact with the first arcuate contact section thereby resulting in a uniform electrical engagement of the ferrule by both arcuate contact sections. Another embodiment allows installation in knife-blade type fuse clips.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be understood from the following description of the preferred embodiments when read in connection with the accompanying drawings wherein like numbers have been employed in the different figures to denote the same parts and wherein:

FIG. 1 is an isometric view of a ferrule type cartridge fuse positioned above a fuse holder for a ferrule type cartridge fuse of a higher amperage rating than the fuse illustrated in this figure;

FIG. 2 is an isometric view showing the fuse illustrated in FIG. 1 with a fuse adapter according to the present invention mounted on each of the end ferrules and operably installed in the fuse holder of FIG. 1;

DESCRIPTION OF THE PREFERRED EMBODIMENTS

Ferrule to Ferrule Adaptor

Figure 3:
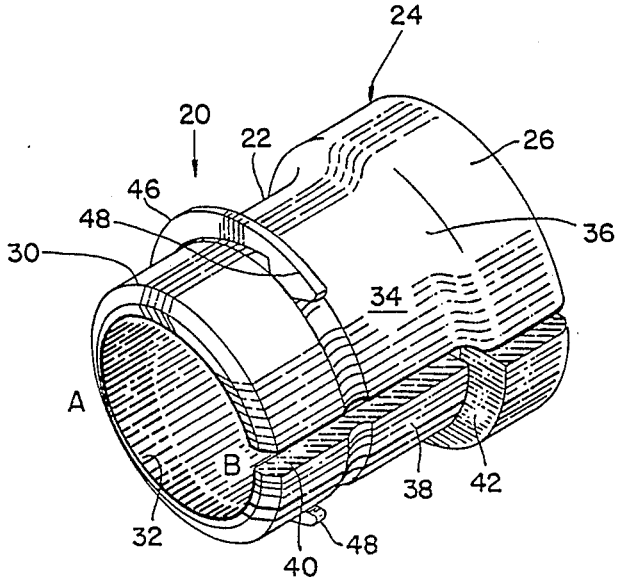
FIG. 3 is an enlarged perspective view of the fuse adapter of the present invention.
Figure 4:
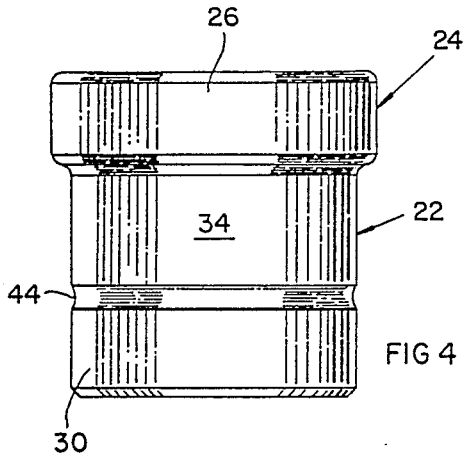
FIG. 4 is a plan view of the body of the adapter shown in FIG. 3 with the retaining ring removed.
Figure 7:
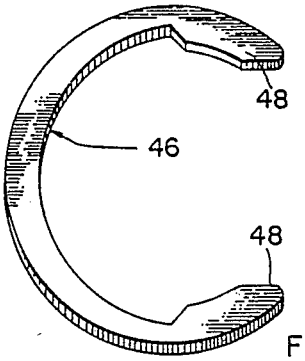
FIG. 7 is a perspective view of the crescent type external retaining ring used on the adapter shown in FIG. 3.
Figure 5:
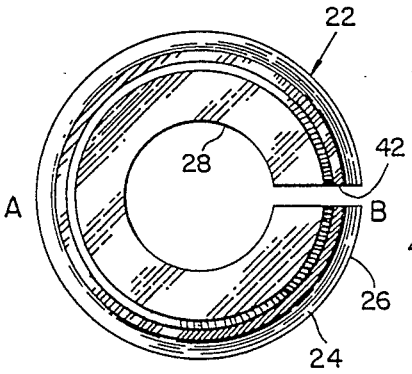
FIG. 5 is an end elevational view of the body of the adapter shown in FIG. 3 with the retaining ring removed.

Referring to FIG. 1 reference numeral 10 identifies a 30 amp 600 volt ferrule-type cartridge fuse. Reference numeral 12 refers to a 60 amp 600 volt ferrule-type fuse holder. Fuse holder 12 comprises an insulating base 14 and a pair of ferrule receiving fuse clips 16 mounted at opposite ends thereof. The cartridge fuse 10 comprises an elongated insulating casing 17 which is closed at opposite ends by a pair of ferrule-type terminals 18. It will be evident from reference to FIG. 1 that the fuse 10 cannot be operably installed in the fuse holder 12 because the diameter of the ferrules 18 is too small to be electrically conductively received in the clips 16 and, further, the spacing between the ferrules 18 is considerably less than the spacing between the clips 16 of the fuse holder 12.

FIG. 2 shows the fuse 10 of FIG. 1 with a pair of ferrule to ferrule fuse adapters 20 installed on the end terminals 18. The fuse 10 with the adapters 20 so installed is in turn mounted in the fuse holder 12 with the adapters 20 electrically conductively received in the clips 16 of the fuse holder 12.

Referring now to FIGS. 3 through 7 the ferrule to ferrule fuse adapter 20 will be described in detail. The adapter body 22 is generally cylindrical in shape and, preferably is machined from a single piece of a highly conductive copper alloy. The body comprises a fuse clip engaging portion 24 which has an outside diameter 26 adapted to operably engage the fuse clips of the holder in which the adapter is to be installed. The fuse clip engaging portion 24 has a centrally located bore 28 extending therethrough which has a diameter substantially smaller than its outside diameter 26. This allows the clip engaging portion 24 to be structurally very strong and yet allows good heat transfer from the ferrule terminals 18. The bore opening 28 also allows a visual check that the adapter 20 is properly installed on a fuse terminal, as well as facilitating fuse removal by providing an opening through which a tool may be inserted to push out a fuse.

The other end of the body 22 of the adapter 20 comprises the fuse engaging portion 30. The fuse engaging portion includes a cylindrical bore 32 therein for receiving the ferrule type terminal of the cartridge fuse to which it is to be attached. The bore 32 is sized to have an inside diameter which is slightly less than the outside diameter of the ferrule-type terminal which it is sized to receive. The fuse receiving bore 32 is defined by a pair of circumferentially extending arcuate contact sections 34, 38. The first arcuate contact section 34 is integrally formed with and fixed with respect to the fuse clip engaging portion 24 as seen generally at the region indicated by reference numeral 36. The second arcuate contact section 38 is integrally formed with the first arcuate contact section 34 at a first longitudinally extending position indicated by the reference letter A. Further, the first arcuate contact section 34 and the second arcuate contact section 38 are separated from one another at a second longitudinally extending position identified by the reference letter B. The region of separation is identified by reference numeral 40, and, in the preferred embodiment illustrated herein the angular displacement between the first longitudinally extending position A and the second longitudinally extending position B is 180 degrees. As a result, the positions A and B are superimposed upon one another in the view shown in FIG. 6.

Figure 6:
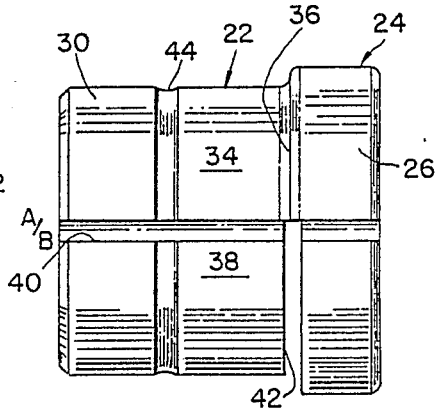
FIG. 6 is a side elevational view of the body of the adapter shown in FIG. 3 with the retaining ring removed.

As best seen in FIGS. 3 and 6 the second arcuate contact section 38 is, further, completely separated from the fuse clip engaging portion 24 of the adapter 20 by a slot 42. The slot 42 extends throughout the arcuate region extending between the first longitudinally extending position A and the second longitudinally extending position B.

The wall thickness of the fuse engaging portion 30, specifically, the wall thickness of the first arcuate contact section 34 and the second arcuate contact section 38 is selected such that the second arcuate contact section is allowed to circumferentially flex with respect to the first contact section 34 and the fuse clip engaging portion 24. This flexing may be visualized as occurring about the first longitudinally extending position A which may be considered as a flexing "hinge" for the second arcuate contact section 38.

As a result of the above described structure, upon insertion of a ferrule type terminal into the bore 32 the second arcuate contact section 38 will uniformly circumferentially expand to adapt to the outside diameter of the ferrule type terminal. The expanded arcuate contact section 38 will act to urge the ferrule type terminal into contact with the first arcuate contact section 34 thereby resulting in a firm uniform electrically conductive contact between both arcuate contact sections 34 and 38 and the outside surface of the ferrule type terminal.

When installing the fuse adapter 20 onto a ferrule type terminal it is recommended that the fuse be rotated in a clockwise direction (as viewed from the fuse looking toward the adapter) as the fuse is pushed into the fuse receiving bore 32 of the adapter. As a result of such rotation the frictional engagement between the ferrule outer surface and the inner surface of the arcuate contact section 38 results in a force which causes the arcuate section 38 to flex outwardly and reduces the force necessary to achieve insertion of the fuse. The same procedure facilitates removal of a fuse from the adapter.

Such clockwise rotation has an added benefit when the adapter is used with a fuse having ferrules that screw on. The rotation serves to tighten the ferrule to fuse tube connection thus assuring that the ferrule will not come unscrewed and stuck inside the reducer.

A circumferentially extending annular groove 44 is machined in the outer surface of the fuse engaging portion 30. Received in the groove 44 is a crescent type external retaining ring 46 or other equivalent mechanical device. Such rings are commercially available items and no further detailed description is deemed necessary. The ring 46 is snap fit into the groove 44, and, because it extends through an angle greater than 180 degrees it retains itself in the groove. As best seen in FIG. 3 the ring 46 extends around and encloses a substantial portion of each of the arcuate contact sections 34 and 38. The ring is positioned such that the region of separation 40 between the two arcuate contact sections lies substantially equidistant from the ends 48 of the ring 46. Such positioning of the ring enables the ring to assure positive contact between the fuse engaging portion 30 and the ferrule-type terminal. At the same time this positioning allows the above described flexing of the second arcuate contact surface to take place as necessary for a particular ferrule/adapter assembly.

It should thus be appreciated that the described flexing structure along with the retaining ring, allows acceptance of out-of-round ferrules and ferrules of different outside diameters within a reasonable range. Further the retaining ring overcomes hysteresis during a loading cycle of the adapter.

As pointed out above, in the preferred embodiment, the body 22 of the adapter 20 is machined from a highly conductive copper alloy. The retaining rings 46 are made of steel. Prior to assembly, the rings are plated with zinc dichromate and the adapter is copper flashed and plated with tin.

Ferrule to Blade Adapter

Figure 8:
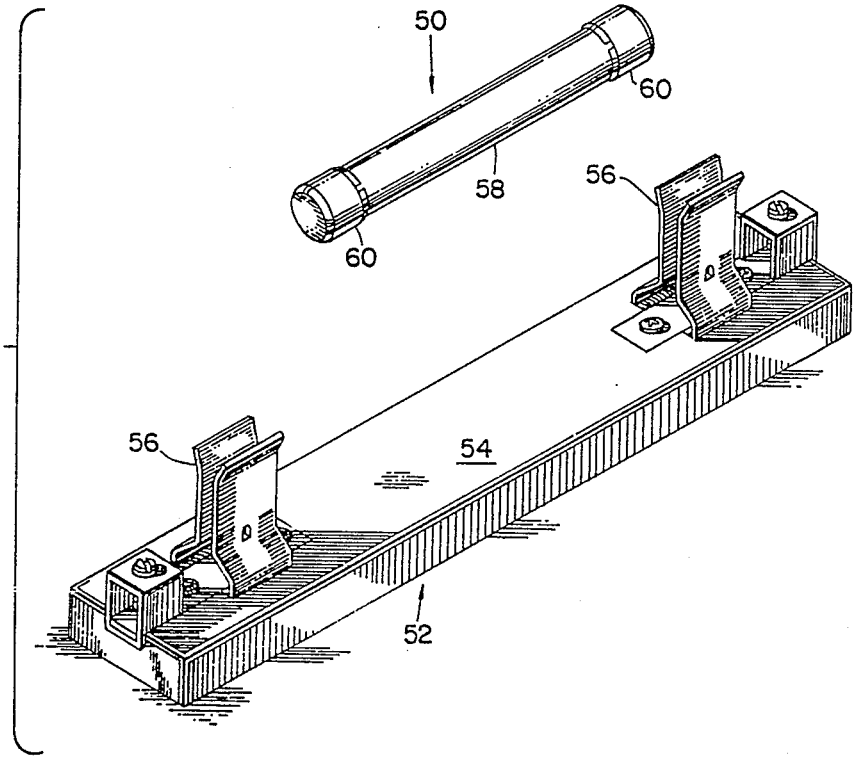
FIG. 8 is a perspective view showing a ferrule type cartridge fuse and a knife-blade type fuse holder of a higher amperage rating in which it is desired to mount the illustrated cartridge fuse.

Referring to FIG. 8 reference numeral 50 identifies a 60 amp 250 volt ferrule-type cartridge fuse. Reference numeral 52 refers to a 100 amp 250 volt blade-type fuse holder. The fuse holder 52 comprises an insulating base 54 and a pair of knife-blade receiving fuse clips 56 mounted at opposite ends thereof. The cartridge fuse 50 comprises an elongated insulating casing 58 which is closed at opposite ends by a pair of ferrule-type terminals 60. It is obvious that the ferrule-type fuse 50 may not be operably installed in the fuse holder 52 with its knife-blade type fuse clips.

Figure 9:
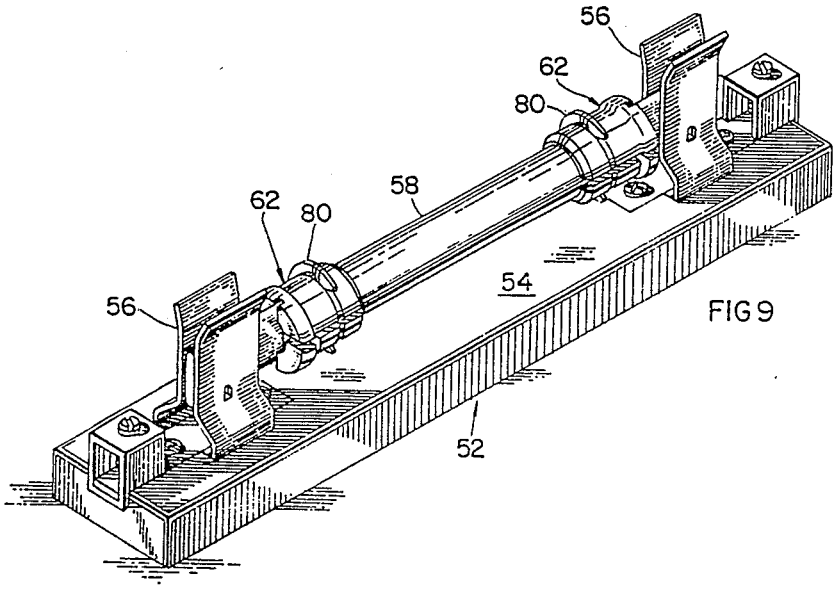
FIG. 9 is a perspective view showing the ferrule type cartridge fuse of FIG. 8 with a ferrule to blade type fuse adapter installed on each end ferrule and installed in the knife-blade type fuse holder of FIG. 8.

FIG. 9 shows the fuse 50 of FIG. 8 with a pair of ferrule-to-blade fuse adapters 62 so installed is in turn mounted in the fuse holder 50 with the adapters 62 installed on the end terminals 60. The fuse 50 with the adapters 62 electrically conductively received in the knife-blade type clips 56 of the fuse holder 52.

Referring now to FIGS. 10–14 the ferrule to blade fuse adapter 62 will be described in more detail. The adapter body 64 is substantially identical to the adapter body 22 of the ferrule-to-ferrule fuse adapter 20 described hereinabove. It is generally cylindrical in shape and is preferably machined from a single piece of a highly conductive copper alloy. The fuse engaging portion 66 of the ferrule-to-blade adapter 62 is identical to the fuse engaging portion 30 of the ferrule-to-ferrule adapter 22. Accordingly, no further detailed description of the fuse engaging portion of the ferrule-to-blade adapter will be made.

The other end of the body of the ferrule-to-blade adapter 62 comprises an intermediate portion 68 integrally formed with the fuse engaging portion 66 in the same manner that the fuse clip engaging portion 24 and the fuse engaging portion 30 are integrally formed in the above described ferrule-to-ferrule adapter. It will be evident upon comparison of figures 10–14 with figures 3–7 that the intermediate portion 68 of the ferrule-to-blade adapter 62 is substantially identical to the fuse clip engaging portion 24 of the ferrule-to-ferrule adapter 20.

Figure 10:
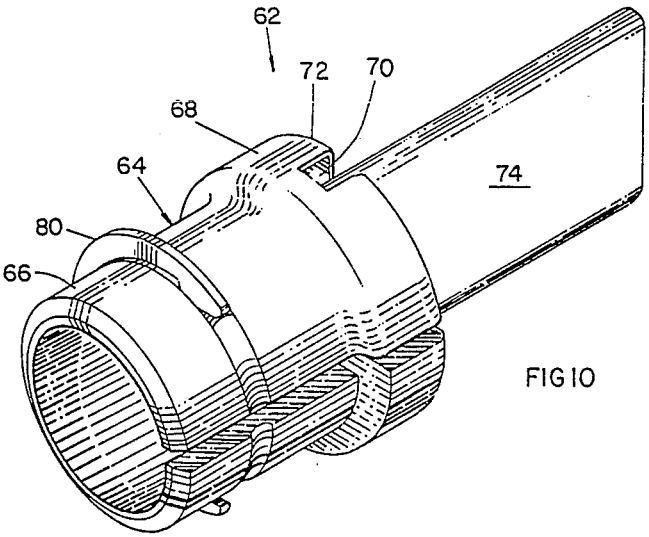
FIG. 10 is a perspective view of the ferrule to knife blade terminal adapter used on the fuse shown in FIG. 9.
Figure 11:
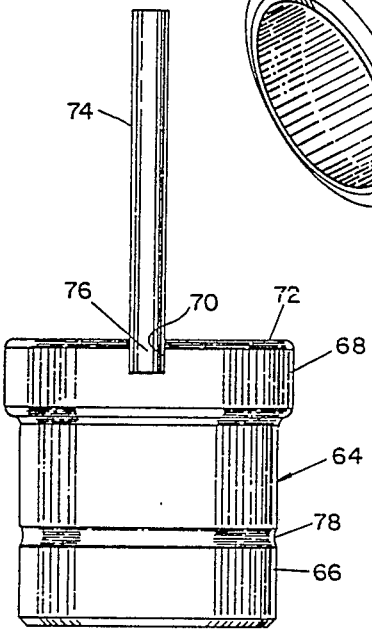
FIG. 11 is a plan view of the body of the adapter shown in FIG. 10 with the retaining ring removed.
Figure 14:
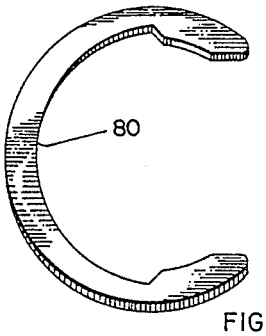
FIG. 14 is a perspective view of the crescent type external retaining ring used on the adapter of FIG. 10.
Figure 12:
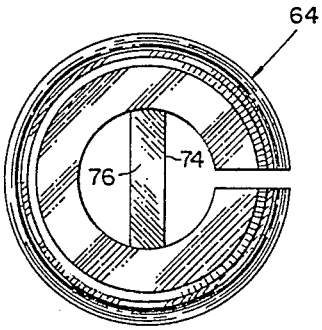
FIG. 12 is an end elevational view of the body of the adapter shown in FIG. 10 with the retaining ring removed.
Figure 13:
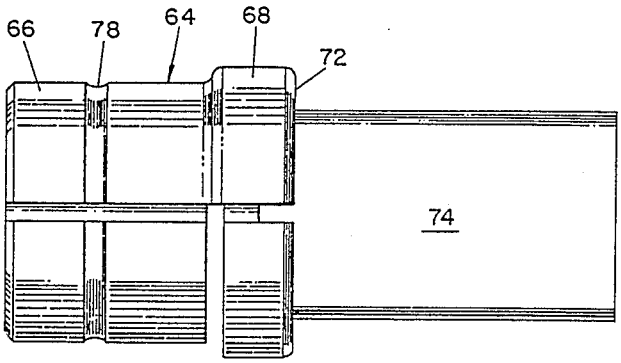
FIG. 13 is a side elevational view of the body of the adapter shown in FIG. 10 with the retaining ring removed.

As best seen in FIGS. 10 and 11 the intermediate portion 68 is provided with a deep diametrically extending groove 70 machined in its axially outwardly facing end 72. A knife-blade type contact 74 has one end 76 received in the groove 70 with the remainder of the blade extending axially outwardly from the intermediate portion 68. The end of the blade 76 is brazed to the intermediate portion 68 by use of a copper-phosphorous bronze filler alloy.

As with the ferrule-to-ferrule adapter 20 the ferrule to blade adapter 62 is provided with an annular groove 78 in which is mounted a crescent type external retaining ring 80 for all of the same reasons as set forth hereinabove for the ferrule-to-ferrule embodiment.

As is evident from the foregoing description of the preferred embodiments both the ferrule-to-ferrule adapter 20 and the ferrule-to-blade adapter 62 are readily mounted on the ferrule type terminals of cartridge fuses by simply inserting the ferrule terminals of the fuse into the fuse engaging portions of the adapters. A cartridge fuse having a pair of the adapters of the present invention mounted thereon, whether it be a pair of ferrule-to-ferrule adapters or a pair of ferrule-to-blade adapters, comprises an extremely rugged assembly. As a result, the fuse, with such adapters mounted thereon, may be readily installed in the fuse clips of an appropriately sized fuse holder using whatever force may be necessary without fear of weakening, distorting, falling off or loss of proper electrical connection between the adapters/fuse/fuse clips. The simplicity and ruggedness of the design results in a highly reliable component which can be expected to give an extremely long usage life even with repeated insertions and removals of fuses therefrom.

What is claimed is:

1. An adapter for one of the ferrule-type terminals of a ferrule-type cartridge fuse, which makes it possible to couple the one terminal of the fuse to a fuse clip which is adapted to operably engage a ferrule terminal of a larger size, said adapter comprising:

(a) a body;

(b) a fuse clip engaging portion forming one end of said body;

(c) a fuse engaging portion at the other end of said body, said fuse engaging portion having a bore therein for receiving the one ferrule-type terminal of the cartridge fuse, said bore having a diameter slightly less than the outside diameter of the ferrule-type terminal to be received therein, said fuse receiving bore being defined by a first circumferentially extending arcuate contact section, said first contact section being integrally formed with and substantially fixed with respect to said fuse clip engaging portion; and a second circumferentially extending arcuate contact section, said second contact section being integrally formed with said first arcuate section at a first longitudinally extending position on the circumference of said fuse receiving portion, said first arcuate section and said second arcuate section being separated from one another at a second longitudinally extending position which is angularly displaced from said first longitudinally extending position on the circumference of said fuse receiving portion; said second arcuate section being completely separated from said fuse clip engaging portion in the arcuate region extending between said first and second longitudinally extending positions;

(d) said second circumferentially extending arcuate contact section having a wall thickness which allows it to circumferentially flex with respect to said first contact section and said fuse clip engaging portion; whereby upon insertion of the ferrule-type terminal into said bore said second arcuate section uniformly circumferentially expands to adapt to the outside diameter of the ferrule-type terminal.

2. The adapter of claim 1 wherein said fuse engaging portion has an annular groove extending about its periphery; and including a retaining ring extending through an angle greater than 180 degrees which is received in said annular groove and is positioned so that it does not enclose said second longitudinally extending position.

3. The adapter of claim 1 wherein said first longitudinally extending position and said second longitudinally extending position are angularly displaced by approximately 180 degrees.

4. An adapter for one of the ferrule-type terminals of a ferrule-type cartridge fuse, which makes it possible to couple the one terminal of the fuse to a fuse clip which is adapted to operably engage a knife-blade type terminal, said adapter comprising:

(a) a body;

(b) a fuse clip engaging portion forming one end of said body, said fuse clip engaging portion comprising a knife-blade adapted to be operably received in the knife-blade type terminal, and, an intermediate portion having a lateral dimension at least as wide as the width of said knife-blade, said knife-blade being rigidly connected thereto;

(c) a fuse engaging portion at the other end of said body, said fuse engaging portion having a bore therein for receiving the one ferrule-type terminal of the cartridge fuse, said bore having a diameter slightly less than the outside diameter of the ferrule-type terminal to be received therein; said fuse receiving bore being defined by a first circumferentially extending arcuate contact section, said first contact section being integrally formed with and substantially fixed with respect to said intermediate portion of said fuse clip engaging portion; and a second circumferentially extending arcuate contact section, said second contact section being integrally formed with said first arcuate section at a first longitudinally extending position on the circumference of said fuse receiving bore, said first arcuate section and said second arcuate section being separated from one another at a second longitudinally extending position which is angularly displaced from said first longitudinally extending position on the circumference of said fuse receiving bore; said second arcuarte section being completely separated from said intermediate portion of said fuse clip engaging portion in the arcuate region extending between said first and second longitudinally extending positions;

(d) said second circumferentially extending arcuate contact section having a wall thickness which allows it to circumferentially flex with respect to said first contact surface and said intermediate portion of said fuse clip engaging portion; whereby upon insertion of the ferrule-type terminal into said bore said second arcuate section uniformly circumferentially expands to adapt to the outside diameter of the ferrule-type terminal.

5. The adapter of claim 4 wherein said fuse engaging portion has an annular groove extending about its periphery; and including a retaining ring extending through an angle greater than 180 degrees which is received in said annular groove and is positioned so that is does not enclose said second longitudinally extending position.

6. The adapter of claim 4 wherein said first longitudinally extending position and said second longitudinally extending position are angularly displaced by approximately 180 degrees.

* * * * *